US009332370B2

(12) United States Patent
Zajac et al.

(10) Patent No.: US 9,332,370 B2
(45) Date of Patent: May 3, 2016

(54) METHOD AND APPARATUS FOR USING SPATIAL AUDIO RENDERING FOR A PARALLEL PLAYBACK OF CALL AUDIO AND MULTIMEDIA CONTENT

(71) Applicant: FutureWei Technologies, Inc., Plano, TX (US)

(72) Inventors: Adam K. Zajac, San Diego, CA (US); Anthony J. Mazzola, Ramona, CA (US)

(73) Assignee: Futurewei Technologies, Inc., Plano, TX (US)

( * ) Notice: Subject to any disclaimer, the term of this patent is extended or adjusted under 35 U.S.C. 154(b) by 134 days.

(21) Appl. No.: 14/212,759

(22) Filed: Mar. 14, 2014

(65) Prior Publication Data

US 2014/0270186 A1 Sep. 18, 2014

Related U.S. Application Data

(60) Provisional application No. 61/784,425, filed on Mar. 14, 2013.

(51) Int. Cl.

| | |
|---|---|
| ***H04R 5/00*** | (2006.01) |
| ***H04S 3/00*** | (2006.01) |
| ***H04R 5/02*** | (2006.01) |
| ***H04S 1/00*** | (2006.01) |
| ***H04R 3/04*** | (2006.01) |

(52) U.S. Cl.

CPC *H04S 3/008* (2013.01); *H04R 3/04* (2013.01); *H04R 5/02* (2013.01); *H04S 1/002* (2013.01); *H04S 3/00* (2013.01); *H04S 2400/11* (2013.01)

(58) Field of Classification Search

None

See application file for complete search history.

(56) References Cited

U.S. PATENT DOCUMENTS 8,879,742 B2 * 11/2014 Disch ..... H04S 7/30 381/17

2007/0286426 A1 12/2007 Xiang et al.

OTHER PUBLICATIONS

OpenSL/ES™ Specification, Version 1.1, The Khronos Group Inc., Jan. 18, 2011, 604 pages.

* cited by examiner

*Primary Examiner* — Muhammad N Edun

(74) *Attorney, Agent, or Firm* — Futurewei Technologies, Inc.

(57) ABSTRACT

Dynamic audio rendering can be achieved by modifying the amplitude, phase, and frequency of audio signal components by varying degrees based on characteristics of the audio signal. A rendered audio signal can be produced by scaling the amplitude of an audio signal component by an amount that is dynamically selected according to the audio signal characteristics. A rendered audio signal can also be produced by adjusting/shifting a phase and/or frequency of an audio signal component by an amount that is dynamically selected according to the audio signal characteristics. The audio signal characteristics may correspond to any metric or quality associated with the audio signal, such as an energy ratio of the audio signal in the time domain, a bit-depth, or sampling rate.

28 Claims, 14 Drawing Sheets

METHOD AND APPARATUS FOR USING SPATIAL AUDIO RENDERING FOR A PARALLEL PLAYBACK OF CALL AUDIO AND MULTIMEDIA CONTENT

This patent application claims priority to U.S. Provisional Application No. 61/784,425, filed on Mar. 14, 2013 and entitled "Method and Apparatus for Using Spatial Audio Rendering for a Parallel Playback of Call Audio and Multimedia Content," which is hereby incorporated by reference herein as if reproduced in its entirety.

TECHNICAL FIELD

The present invention relates to a system and method for audio systems, and, in particular embodiments, to a method and apparatus for using spatial audio rendering for a parallel playback of call audio and multimedia content.

BACKGROUND

Mobile devices often play multiple audio signals at the same time. For example, a mobile device may play a multimedia audio signal (e.g., music, etc.) and a voice audio signal simultaneously when an incoming call is received while a user is listening to music or turn-by-turn navigation instructions. It can be difficult for listeners to differentiate between the audio signals when they are being simultaneously emitting over the same speaker(s). Conventional techniques may lower the volume or distort one of the audio signals so that it is perceived as background noise. However, these conventional techniques tend to significantly reduce the sound quality of the rendered audio signal. Accordingly, mechanisms and features for distinguishing between audio signals without significantly reducing their quality are desired.

BRIEF DESCRIPTION OF THE DRAWINGS

For a more complete understanding of this disclosure, and the advantages thereof, reference is now made to the following descriptions taken in conjunction with the accompanying drawing, in which.

Corresponding numerals and symbols in the different figures generally refer to corresponding parts unless otherwise indicated. The figures are drawn to clearly illustrate the relevant aspects of the embodiments and are not necessarily drawn to scale.

SUMMARY OF THE INVENTION

Figure 1:
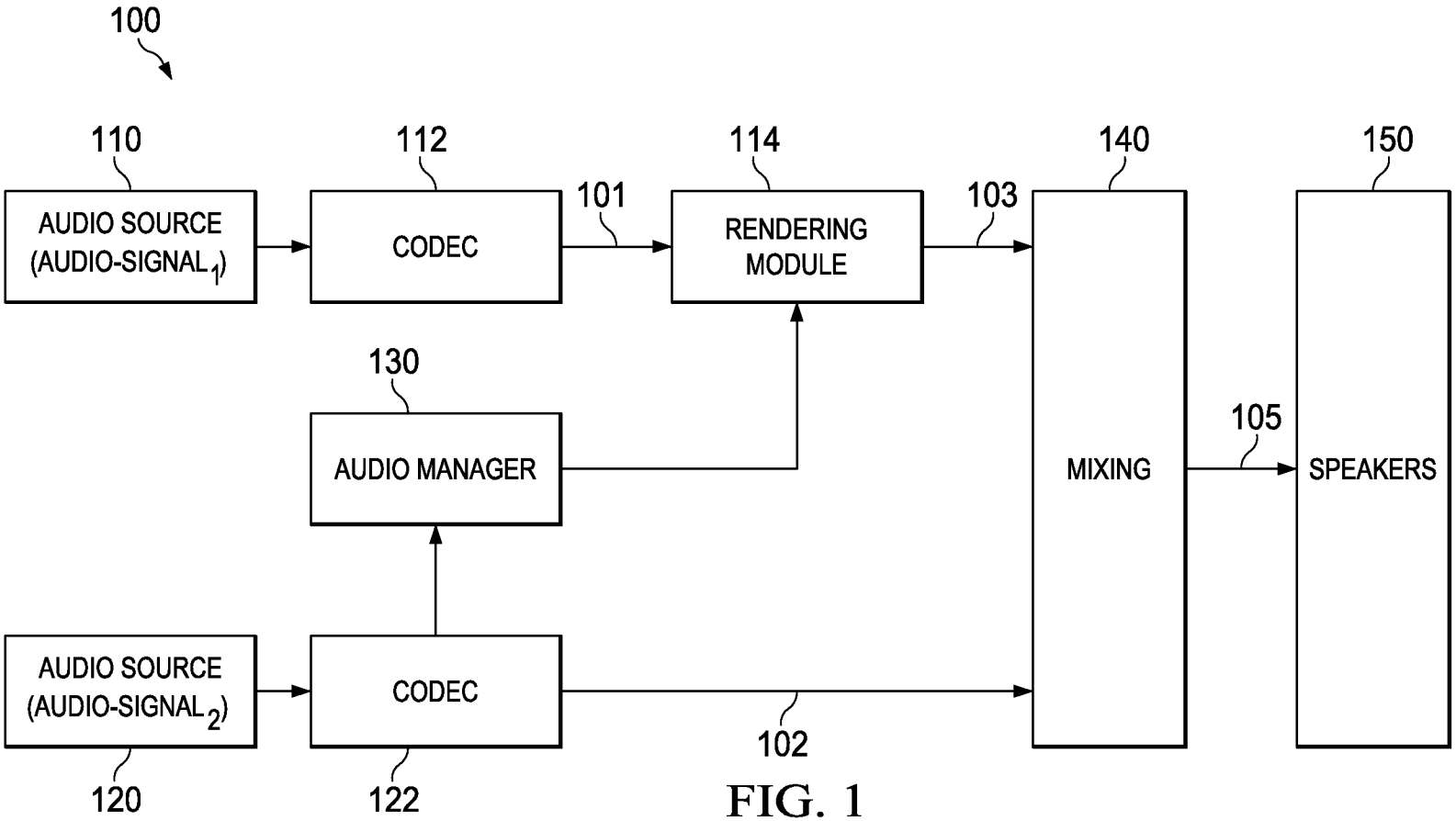
FIG. 1 illustrates a diagram of an embodiment audio device adapted to differentiate audio signals via 3D-Audio rendering techniques.

Technical advantages are generally achieved, by embodiments of this disclosure which describe a method and apparatus for using spatial audio rendering for a parallel playback of call audio and multimedia content.

In accordance with an embodiment, a method for differentiating audio signals is provided. In this example, the method includes obtaining a first audio stream corresponding to a first audio signal and a second audio stream corresponding to a second audio signal, performing audio rendering on the first audio stream, and simultaneously emitting the rendered audio stream and the second audio stream over one or more speakers. The first audio signal and the second audio signal are perceived in different locations of a 3D audio (3D-Audio) virtual space by virtue of performing audio rendering on the first audio stream. An apparatus for performing this method is also provided.

In accordance with another embodiment, a method for manipulating audio streams is provided. In this example, the method includes emitting a first audio stream over one or more speakers during a first period, detecting a second audio stream corresponding to an incoming call, and performing dynamic audio rendering on the first audio stream during a second period to obtain a rendered audio stream. The first audio stream corresponds to a first audio signal that is perceived in a front source of a three dimensional audio (3D-Audio) virtual space during the first period. The method further incudes simultaneously emitting the rendered audio stream and the second audio stream over the one or more speakers during the second period. Audio of the incoming call is perceived in the front source of the 3D-Audio virtual space during the second period. The first audio signal gradually migrates from the front source to a rear source of the 3D-Audio virtual space during the second period by virtue of performing the dynamic audio rendering on the first audio stream. An apparatus for performing this method is also provided.

DETAILED DESCRIPTION OF ILLUSTRATIVE EMBODIMENTS

The making and using of the embodiments provided herein are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Conventional techniques for distinguishing between audio signals modify the amplitude, frequency, and phase of a secondary signal when mixing the audio signals to cause the secondary signal to be perceived as diffuse background noise. One such technique is discussed in United States Patent Application 2007/0286426, which is incorporated herein by reference as if reproduced in its entirety. One disadvantage to this approach is that it manipulates the clarity and/or sound quality of the audio signal. Moreover, this approach modifies the amplitude, frequency, and phase of the secondary audio signal using hardware components in the drive circuitry of the audio system, which statically defines the degree in which the components are modified. As such traditional techniques are unable to adapt to audio signals exhibiting different characteristics, and may tend to muffle some audio signals more than others, thereby further reducing the sound quality perceived by the listener.

Aspects of this disclosure provide three dimensional audio (3D-Audio) rendering techniques that modify signal parameters of an audio stream in order to shift the perceived audio signal to a different 3D spatial location relative to a listener. For example, embodiment 3D-Audio rendering techniques may allow audio channels to be separated in a 3D-Audio virtual space, thereby providing an illusion that one audio signal is originating from a source positioned in-front of the listener, while another audio signal is originating from behind the listener. In some embodiments, audio rendering may be performed dynamically by adjusting the manner in which audio signal components are modified based on characteristics of the audio signal. This allows the audio rendering to be individually tailored to different audio signal types, thereby producing a higher quality rendered audio signal. More specifically, dynamic audio rendering modifies the amplitude, phase, and frequency of one or more audio signal components by varying degrees based on characteristics of the audio signal. In an embodiment, a rendered audio signal is produced by scaling the amplitude of an audio signal component by an amount that is dynamically selected according to the audio signal characteristics. In the same or other embodiments, a rendered audio signal is produced by adjusting/shifting a phase and/or frequency of an audio signal component by an amount that is dynamically selected according to the audio signal characteristics. As an example, the audio signal component may be amplified, phase-shifted, and/or frequency-shifted by different amounts depending on whether the audio signal characteristics satisfy a criteria (or set of criteria). The criteria can be any benchmark or metric that tends to affect signal quality during audio rendering. In some embodiments, the audio signal characteristics satisfy a criteria when an energy ratio of the audio signal in the time domain exceeds a threshold. These and other aspects are described in greater detail below.

FIG. 1 illustrates an embodiment audio device 100 adapted to differentiate audio signals via 3D-Audio rendering techniques. As shown, the audio device 100 includes audio sources 110, 120, codecs 112, 122, an audio rendering module 114, and audio manager 130, a mixing module 140, and speakers 150. The audio sources 110, 120 may include any component or collection of components configured to generate, store, or provide audio data to the audio codecs 112, 122, such as audio data storage devices, voice processing circuitry, multimedia content processing circuitry, etc. The audio codecs 112, 122 may include any component or collection of components configured to convert audio data into an audio stream. The audio source 110 may be configured to provide audio data for a first audio signal to the audio codec 112, which may convert the audio data to an audio stream 101. The audio source 120 may be configured to provide audio data for a second audio signal to the audio codec 122, which may convert the audio data to an audio stream 102. The audio manager 130 may detect when the audio codec 122 is generating the audio stream 102 for purposes of actuating the rendering module 114. The rendering module 114 may include any component or collection of components that are capable of performing 3D-Audio rendering on an audio stream to produce a rendered audio stream. Upon being actuated, the rendering module 114 may perform 3D-Audio rendering on the audio stream 101 to obtain the rendered audio stream 103. More specifically, the 3D-Audio rendering module 114 may perform 3D-Audio rendering by amplifying, frequency-shifting, and/or phase-shifting signal components in the received audio stream in a manner that causes the first audio signal to be perceived by a listener in a different location in 3D-Audio virtual space than the second audio signal. In some embodiments, the 3D-Audio rendering module 114 may dynamically select the amount in which the signal components are amplified, frequency-shifted, and/or phase-shifted based on characteristics of the corresponding audio signal. For example, audio signals exhibiting different energy ratios in the time domain may require different amplification, frequency-shift, and/or phase-shift to maintain similar quality levels during 3D-Audio rendering. Audio signals exhibiting different energy ratios may include different types of music (e.g., classical, rock, jazz, etc.) and non-music related voice recordings. For example, different parameters may be used to perform audio rendering on classical music than jazz music. As another example, different parameters may be used to perform audio rendering on non-music multimedia signal (e.g., an audio book) than on music multimedia signals. Other characteristics of audio signals may be used to determine rendering parameters. The mixing module 140 may mix the rendered audio signal 103 with the second audio signal 102 to obtain an output signal 105, which may be emitted over the speakers 150.

Figure 2:
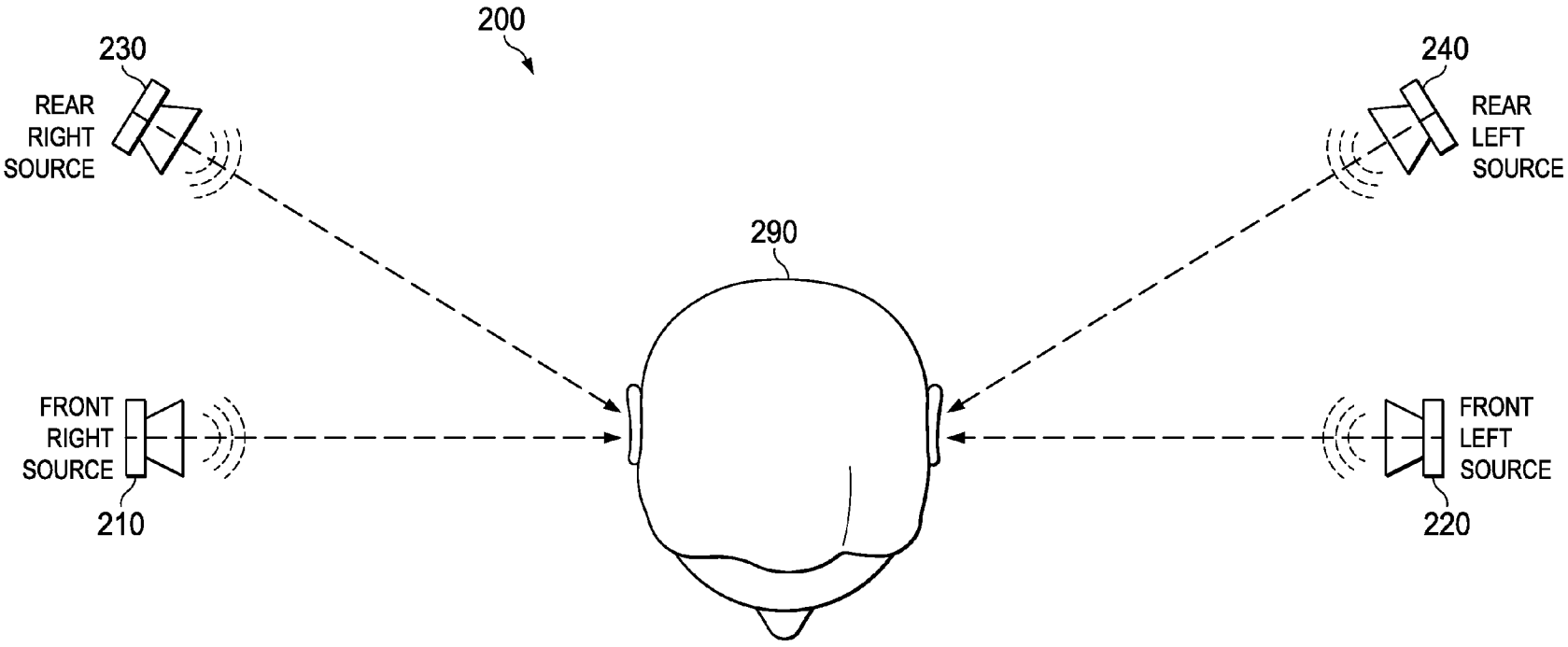
FIG. 2 illustrates a diagram of an embodiment 3D-Audio virtual space.

FIG. 2 illustrates a diagram of an embodiment 3D-Audio virtual space 200 for use in 3D audio rendering. As shown, the 3D-Audio virtual space 200 includes a plurality of locations 210-240 from which an audio signal can be perceived by a listener 290. The plurality of locations 210-240 includes a front right source location 210, a front left source location 220, a rear right source location 230, and a rear left source location 240.

Figure 3:
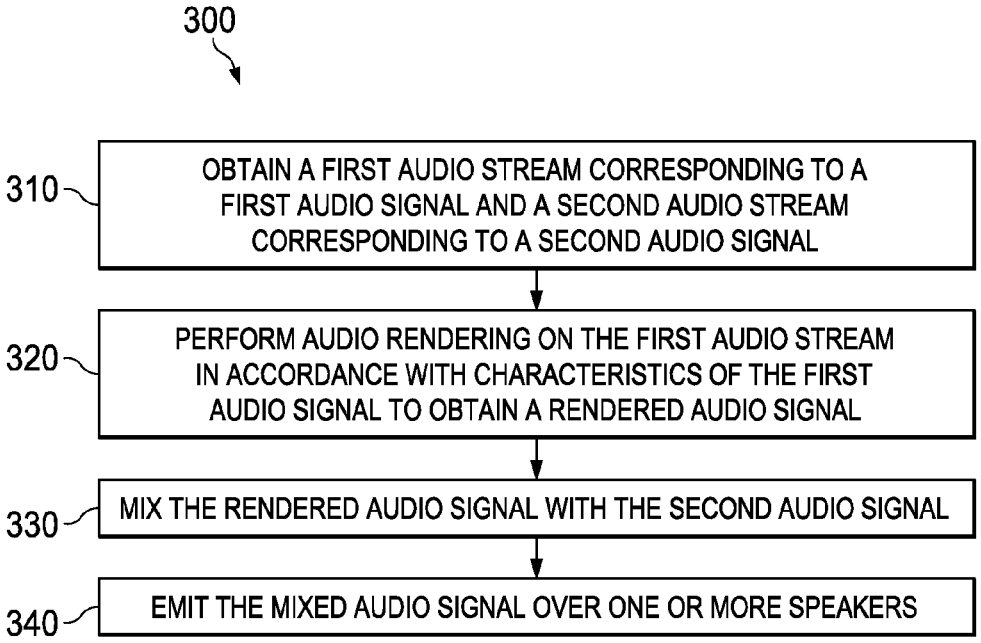
FIG. 3 illustrates a flowchart of an embodiment method for differentiating audio signals in a 3D-Audio virtual space.

Aspects of this disclosure provide techniques for differentiating audio signals in a 3D-Audio virtual space. FIG. 3 illustrates a method 300 for differentiating audio signals in a 3D-Audio virtual space, as may be performed by an audio rendering device. As shown, the method 300 starts at step 310, where the audio rendering device obtains a first audio stream corresponding to a first audio signal and a second audio stream corresponding to a second audio signal. Thereafter, the method 300 proceeds to step 320, where the audio rendering device performs audio rendering on the first audio stream to obtain a rendered audio signal. The audio rendering may be performed by dynamically modifying signal components of the first audio stream based on characteristics of the first audio signal. In some embodiments, dynamically modifying signal components of the first audio stream based on characteristics of the first audio signal includes amplifying, phase-shifting, and/or frequency-shifting a signal component in the first audio stream by different amounts depending on whether the characteristics of the first audio signal satisfy a criteria. In embodiments, the audio signal characteristics satisfy a criteria when an energy ratio of the audio signal in the time domain exceeds a threshold. In other embodiments, the audio signal characteristics satisfy a criteria when a sampling rate of the audio stream exceed a threshold. In yet other embodiments, the audio signal characteristics satisfy a criteria when a bit-depth of the audio stream exceeds a threshold. The sampling rate and/or bit-depth may be derived by the codec during audio decoding based on (for instance) the media header associated with a given format. For example, a media source encoded into an MP3 format may be marked as having a 44 kHz sampling and 16-bit depth format. In yet other embodiments, the criteria may be multi-faceted. For example, the audio signal characteristics may satisfy a criteria when a sampling rate exceeds (or fails to exceed) a first threshold and when a bit-depth exceeds (or fails to exceed) a second threshold. Other characteristics of the audio stream may also affect the amounts in which signal components are modified. Different signal components in the first audio stream can be modified by different amounts (and/or in different manners) to obtain different rendered signal components, which can be combined within one another to obtain the rendered audio stream. The different signal components may fall within different frequency ranges, and can be separated from one another (prior to modification) via frequency selective filtering of the audio stream. Thereafter, the method 300 proceeds to step 330, where the audio rendering device mixes the rendered audio signal with the second audio signal to obtain a mixed audio signal. Next, the method 300 proceeds to step 340, where the audio rendering device emits the mixed audio signal over one or more speakers.

Figure 4A:
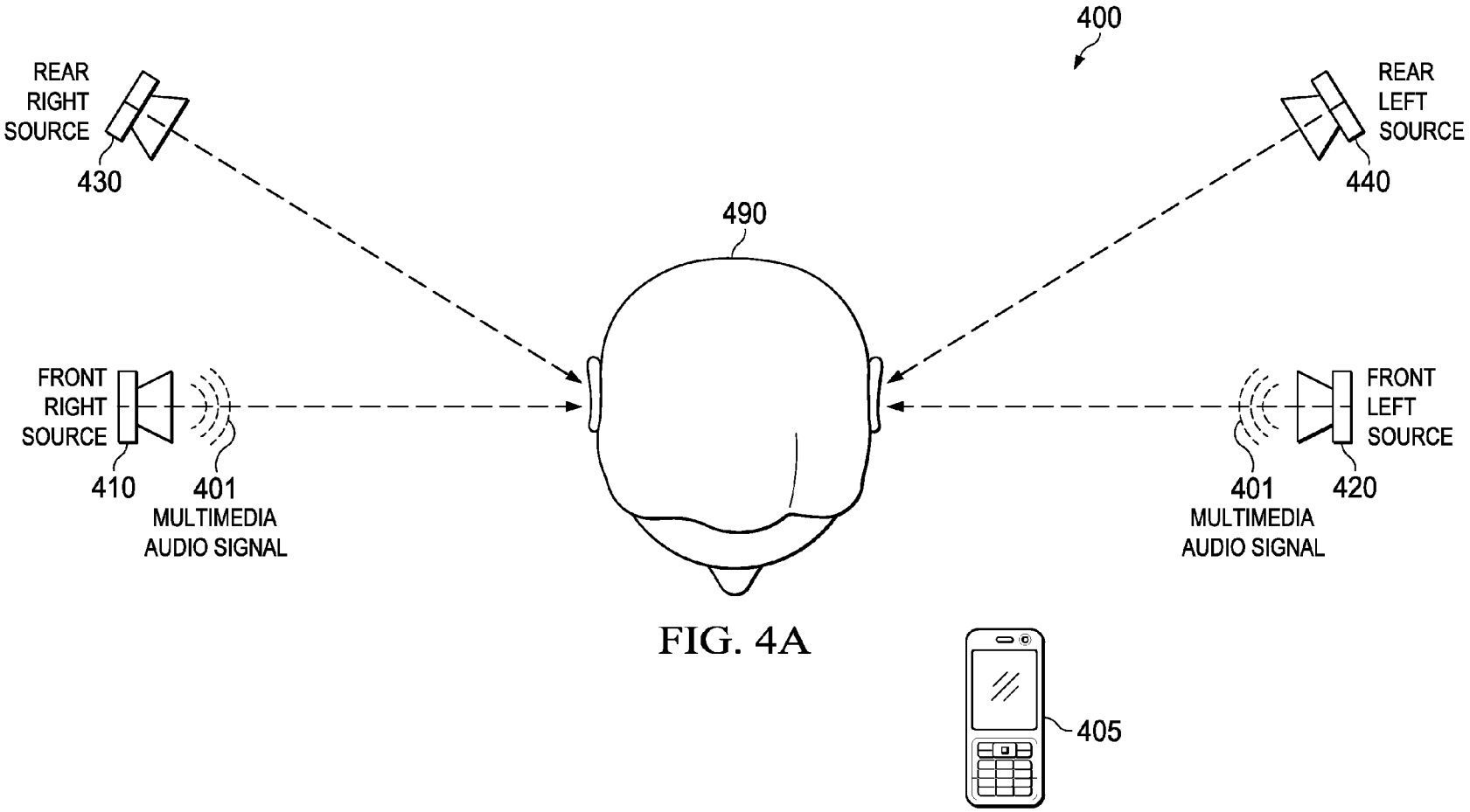
FIGS. 4A-4F illustrate diagrams of a sequence for gradually migrating an audio signal between locations of a 3D-Audio virtual space.
Figure 4B:
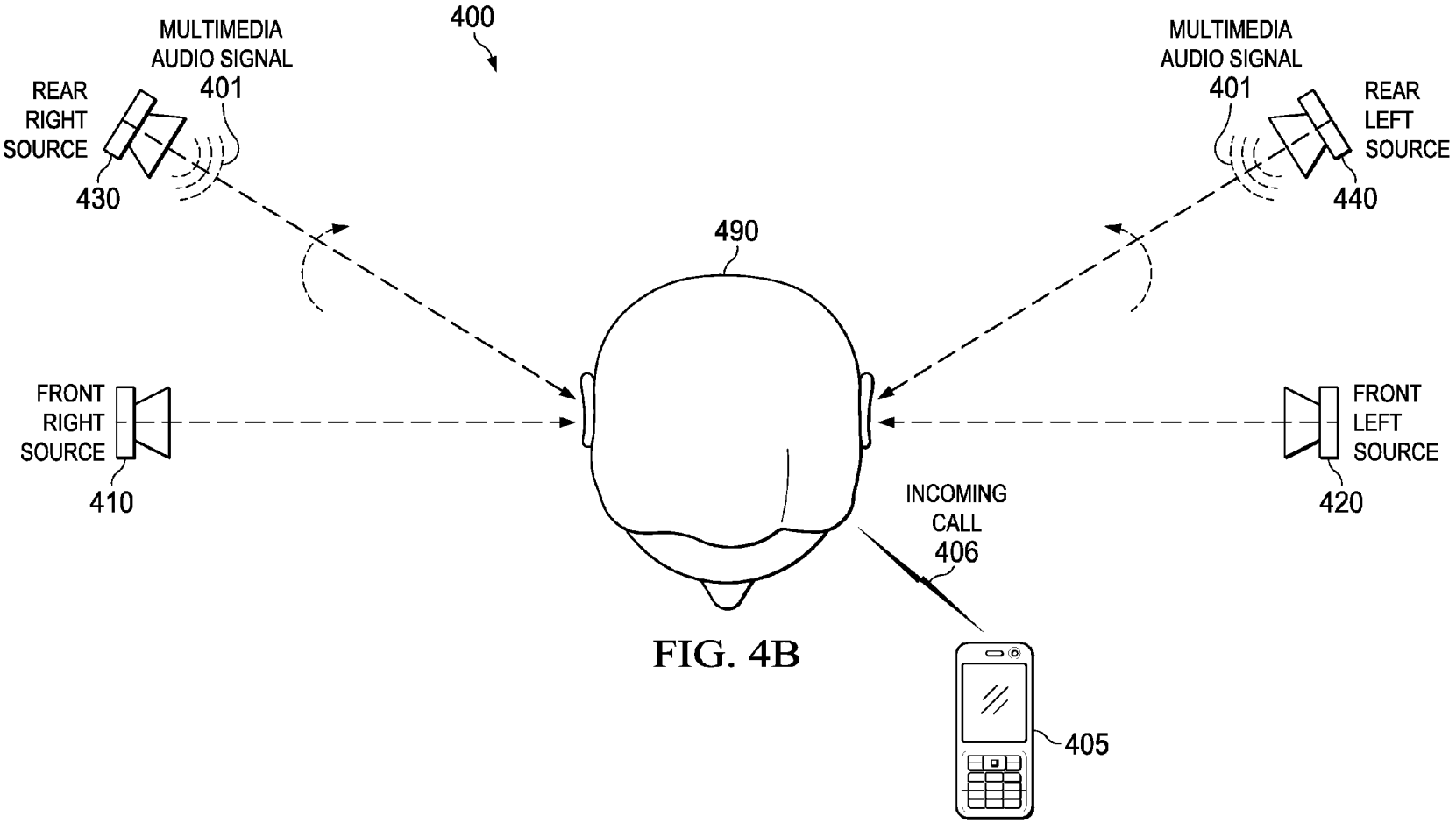

Aspects of this disclosure provide techniques for gradually migrating an audio signal between different locations in a 3D-Audio virtual space. As an example, an audio signal corresponding to multimedia content may be gradually migrated from a front source location to a rear source location when an incoming call is detected so that the multimedia content is perceived as being gradually transitioned to a background from the listener's perspective. The shifting of the multimedia content may be progressive to simulate a user walking away from a speaker or sound source to answer a call. FIGS. 4A-4F illustrate diagrams depicting a sequence for gradually migrating an audio signal 401 between different locations in a 3D-Audio virtual space 400. The 3D-Audio virtual space 400 includes a front right source location 410, a front left source location 420, a rear right source location 430, and a rear left source location 440 relative to a listener 490. The listener 490 begins by listening to a multimedia audio stream on the front audio sources 410, 420 of the 3D-Audio virtual space 400, as shown in FIG. 4A. Thereafter, an incoming call is received on a mobile device 405 of the listener 490, at which point the multimedia audio stream is migrated from the front audio sources 410, 420 to the rear audio sources 430, 440 of the 3D-Audio virtual space 400, as shown in FIG. 4B. In some embodiments, the multimedia audio stream is perceived by the listener 490 to gradually migrate from the front audio sources 410, 420 to the rear audio sources 430, 440 of the 3D-Audio virtual space 400. This can be achieved by progressively changing the amplitude, frequency, or phase of signal components in the multimedia audio stream. For example, gradual migration of the multimedia audio signal 401 may be achieved through progressively amplifying, frequency-shifting, or phase-shifting signal components of the multimedia audio stream from values associated with the front audio sources 430, 440 of the 3D-Audio virtual space 400 to the rear audio sources 430, 440 of the 3D-Audio virtual space 400. The progressive amplification, frequency-shifting, and phase-shifting may be performed over a period in which the migration of the multimedia audio signal 401 is to be perceived by the listener 490. The listener's 490 perception of the gradual migration of the multimedia audio signal 401 may be similar to that of the listener 490 walking out of a room (e.g., a TV or family room) in which the multimedia content is being played to answer the incoming call 406.

Figure 4C:
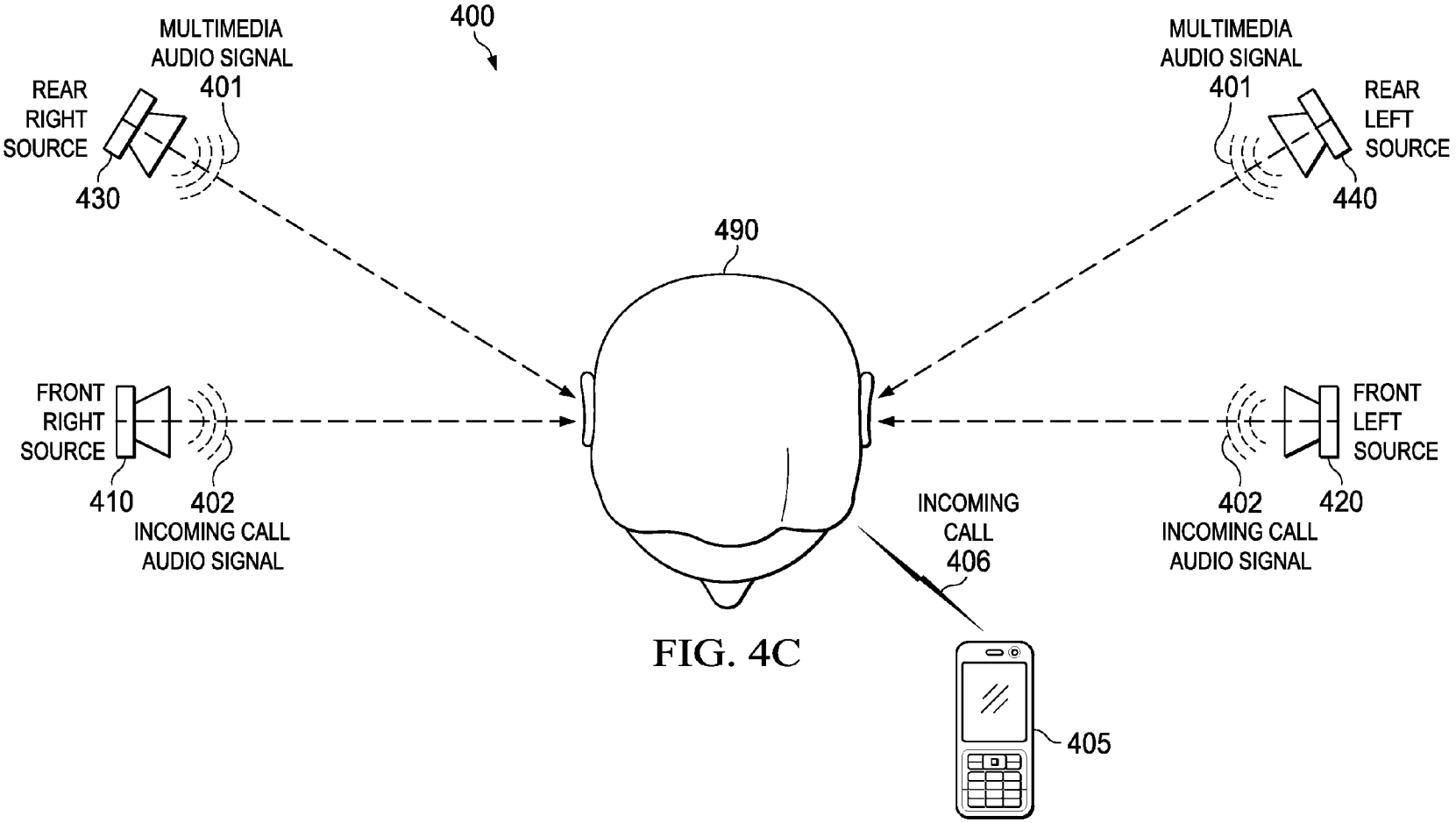
Figure 4D:
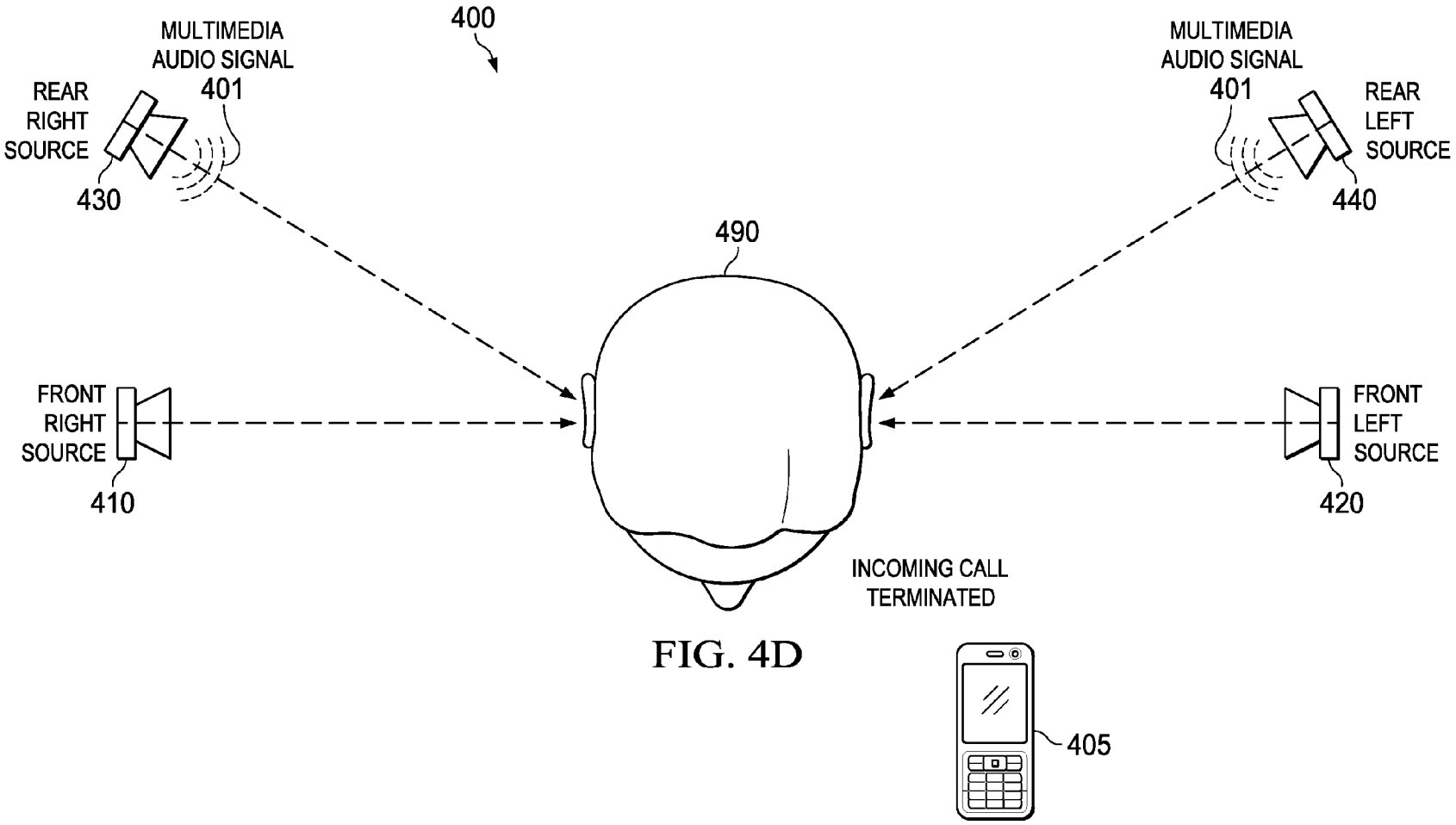
Figure 4E:
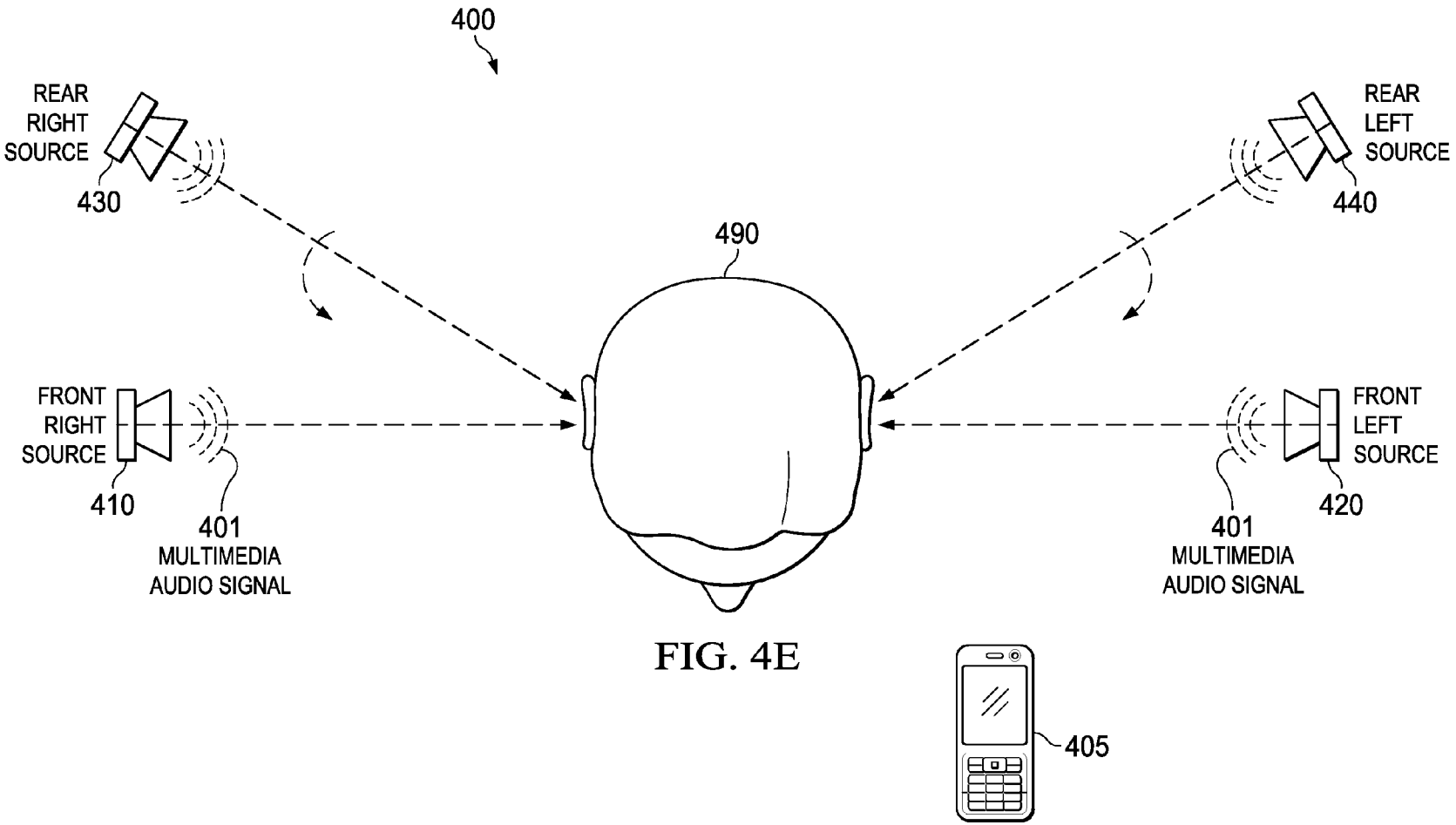
Figure 4F:
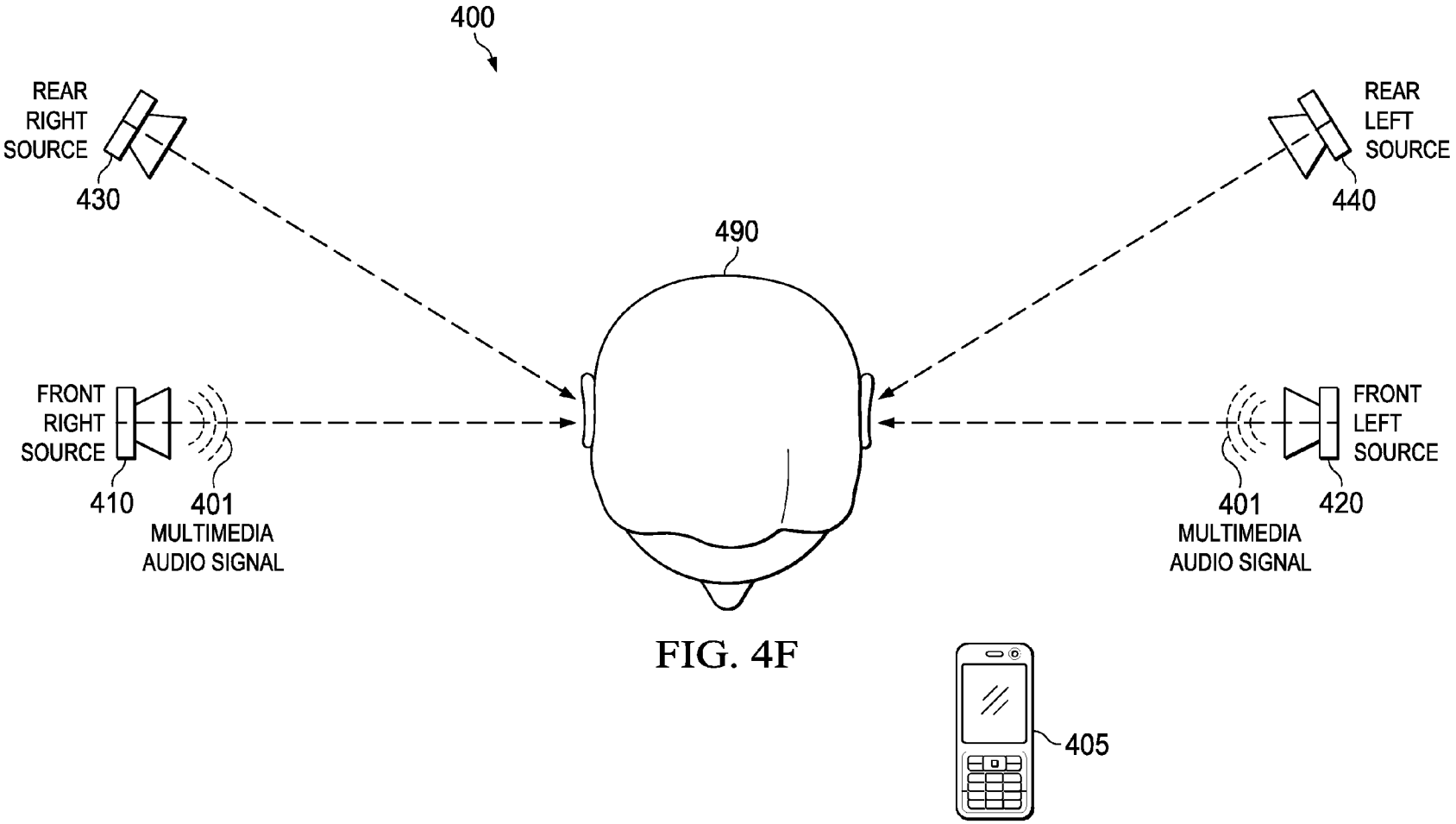

In some embodiments, an audio signal 402 associated with the incoming call 406 may be emitted over the front audio sources 410, 420 of the 3D-Audio virtual space 400 during the period in which the multimedia audio signal 401 is migrated to the rear audio sources 430, 440 of the 3D-Audio virtual space 400. Notably, the front audio sources 410, 420 and/or rear audio sources 430, 440 may be sources in a virtual audio space, and may or may not correspond to actual physical speakers. For example, the front audio sources 410, 420 and/or rear audio sources 430, 440 may correspond to virtual positions in the virtual audio space, thereby allowing the embodiment rendering techniques to be applied with any speaker configuration, e.g., single-speaker systems, multi-speaker systems, headphones, etc. In some embodiments, a sound level of the audio signal 402 associated with the incoming call 406 may be gradually increased as the multimedia audio signal 401 is migrated to the rear audio sources 430, 440 of the 3D-Audio virtual space 400. In other embodiments, the voice signal may be emitted over the front audio sources 410, 420 of the 3D-Audio virtual space 400 after migration of the multimedia audio signal 401 has been completed, as shown in FIG. 4C. Once the incoming call 406 has been terminated, emission of the audio signal 402 associated with the incoming call 406 over the front audio sources 410, 420 of the 3D-Audio virtual space 400 is discontinued, as shown in FIG. 4D. Thereafter, the multimedia audio signal 401 is migrated from the rear audio sources 430, 440 to the front audio sources 410, 420 of the 3D-Audio virtual space 400, as shown in FIG. 4E. Subsequently, the multimedia audio signal 401 is emitted from the front audio sources 410, 420 of the 3D-Audio virtual space 400, as shown in FIG. 4F. Although FIGS. 4A-4F depict an example in which a multimedia media audio signal 401 is differentiated from an audio signal 402 associated with an incoming call 406, these techniques may be used to differentiate any two or more audio signals from one another. Moreover, while the audio signal 402 is discussed in connection with an incoming call 406, other embodiments may deploy similar migration techniques for audio signals associated with outgoing calls, or for any other type of audio signal.

Figure 5:
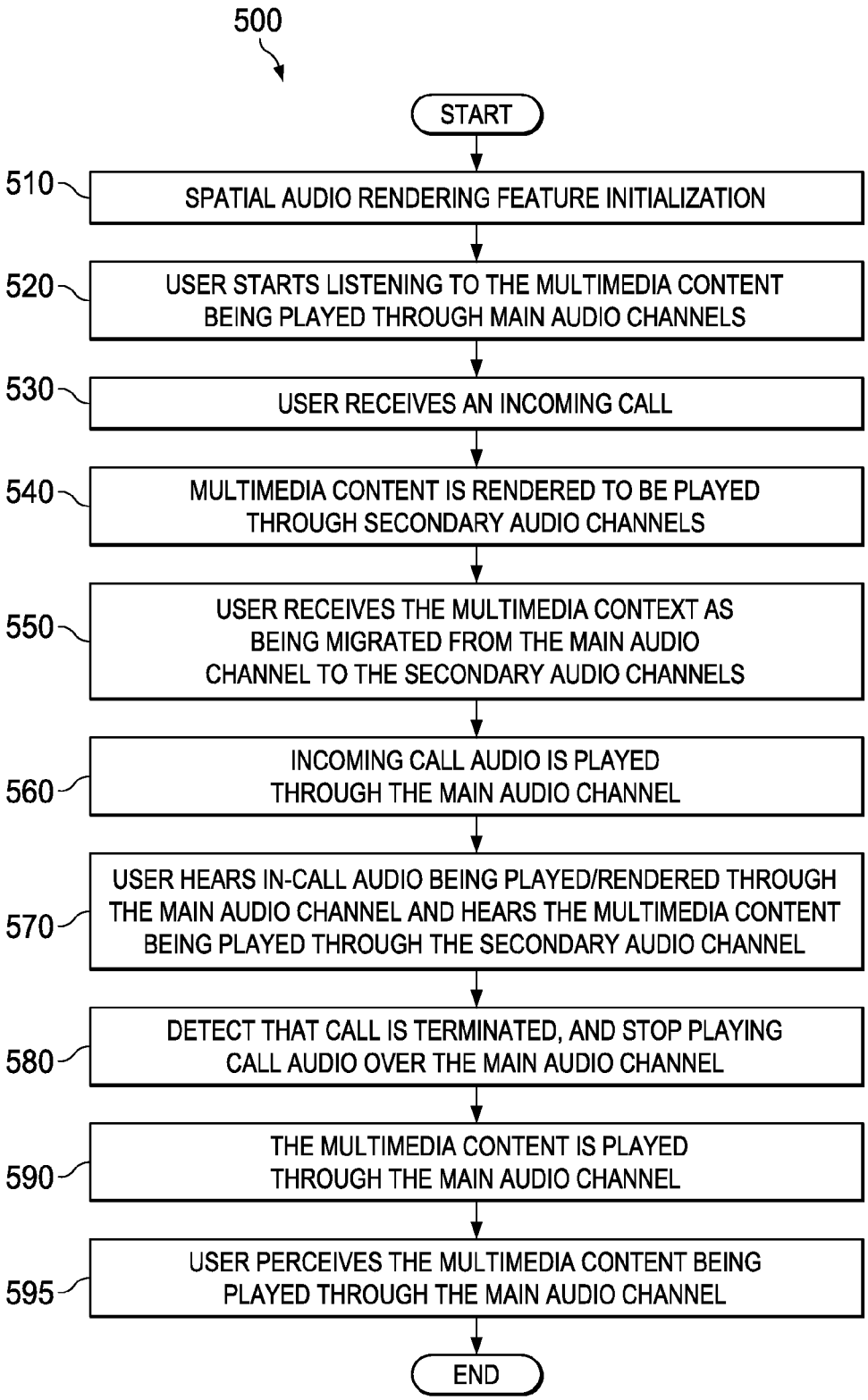
FIG. 5 illustrates a flowchart of an embodiment method for migrating an audio signal between different locations in a 3D-Audio virtual space.

FIG. 5 illustrates a method 500 for gradually migrating an audio signal between different locations in a 3D-Audio virtual space. As shown, the method 500 begins with step 510, where a spatial audio rendering feature is initialized. Next, the method 500 proceeds to step 520, where a user starts listening to multimedia content being played through main audio channels. The multimedia content can correspond to music, navigation, audio books, or any other type of content. Thereafter, the method 500 proceeds to step 530, where the user receives an incoming call. Subsequently, the method 500 proceeds to step 540, where multimedia content is rendered to be played through secondary audio channels. In one example, the main audio channels may correspond to front audio locations in a 3D-Audio virtual space, while secondary audio channels may correspond to rear audio locations in a 3D-Audio virtual space. Alternatively, the main audio channels may correspond to right-side audio locations in a 3D-Audio virtual space, while secondary audio channels may correspond to left-side audio locations in a 3D-Audio virtual space. Other configurations for main and secondary audio channels may be used by embodiments of this disclosure. Next, the method 500 proceeds to step 550, where the user perceives the multimedia content as being migrated from the main audio channel to the secondary audio channel. Thereafter, the method 500 proceeds to step 560, where the incoming call audio is played through the main audio channel. Subsequently, the method 500 proceeds to step 570, where the user hears in-call audio being played through the main audio channel and hears the multimedia content being played through the secondary audio channel. Next, the method 500 proceeds to step 580, where it is detected that the call is terminated, after which the call audio is no longer played over the main audio channel. Subsequently, the method 500 proceeds to step 590, where the multimedia content is played through the main audio channel. Finally, the method 500 proceeds to step 595, where the user perceives the multimedia content as being played through the main audio channel.

Aspects of this disclosure may provide a pleasing and natural audio experience for in-call users, as well as an uninterrupted playback of the multimedia content when the incoming call takes priority for the playback over the main audio channels. Notably, aspects of this disclosure utilize 3D-Audio rendering to simultaneously provide two audio streams to the user without significantly diminishing the quality of the sound. Aspects of this disclosure may be implemented on any device, including mobile phones (e.g., smartphones), tablets, laptop computers, etc. Aspects of this disclosure may enable and/or expose hidden 3D rendering functionality for a sampled audio playback (predefined short audio samples), such as location in 3D space effect, Doppler effect, distance effect, macroscopic effect, etc. Aspects of this disclosure may also provide for the synchronization of 3D audio effects with 3D graphic effects, as well as spatial separation of mixer channels. Further, aspects of this disclosure may enable advanced audio support for 3D global UX engine, allow for concurrent multimedia playback and in-call audio, allow users to continue to listen to music while in a call, and allow for concurrent navigation voice instructions while listening to multimedia.

The 3D-Audio Effects are a group of sound effects that manipulate the image produced by the sound source through virtual positioning of the sound in the three dimensional space. In some embodiments, 3D-Audio Effects provide an illusion that the sound sources are actually positioned above, below, in front, behind, or beside the listener. The 3D-Audio Effects may usually complement graphical effects providing even richer and more immense content perception experience. Significant 3D-Audio Effects include stereo widening, the placement of sounds outside the stereo basis, and complete 3D simulation. Aspects of this disclosure may be used in conjunction with Open Sound Library for Embedded Systems (OpenSL ES) Specification 1.1 (2011), which is incorporated herein by reference as if reproduced in its entirety.

Figure 6:
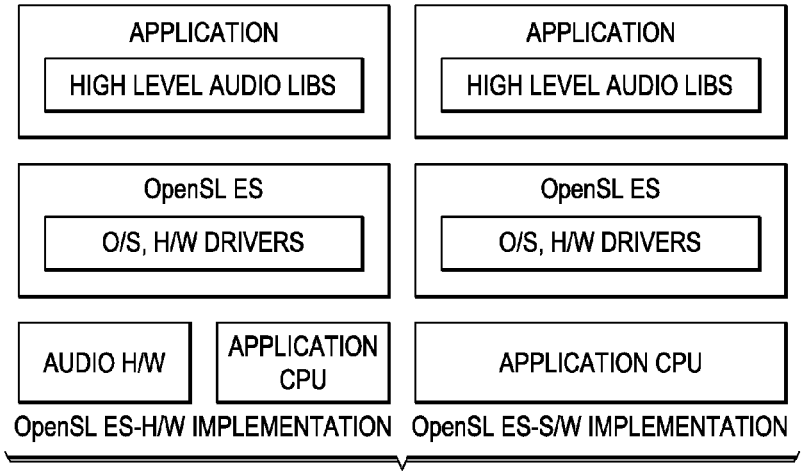
FIG. 6 illustrates a diagram of an embodiment OpenSL ES SW stack.

FIGS. 6 illustrates an example of an OpenSL ES SW stack. OpenSL ES is a cross-platform, hardware-accelerated audio API tuned for embedded systems, and provides a standardized, high-performance, low-latency method to access audio functionality for developers of native applications on embedded mobile multimedia devices, enabling straightforward cross-platform deployment of hardware and software audio capabilities, reducing implementation effort, and promoting the market for advanced audio.

Figure 7:
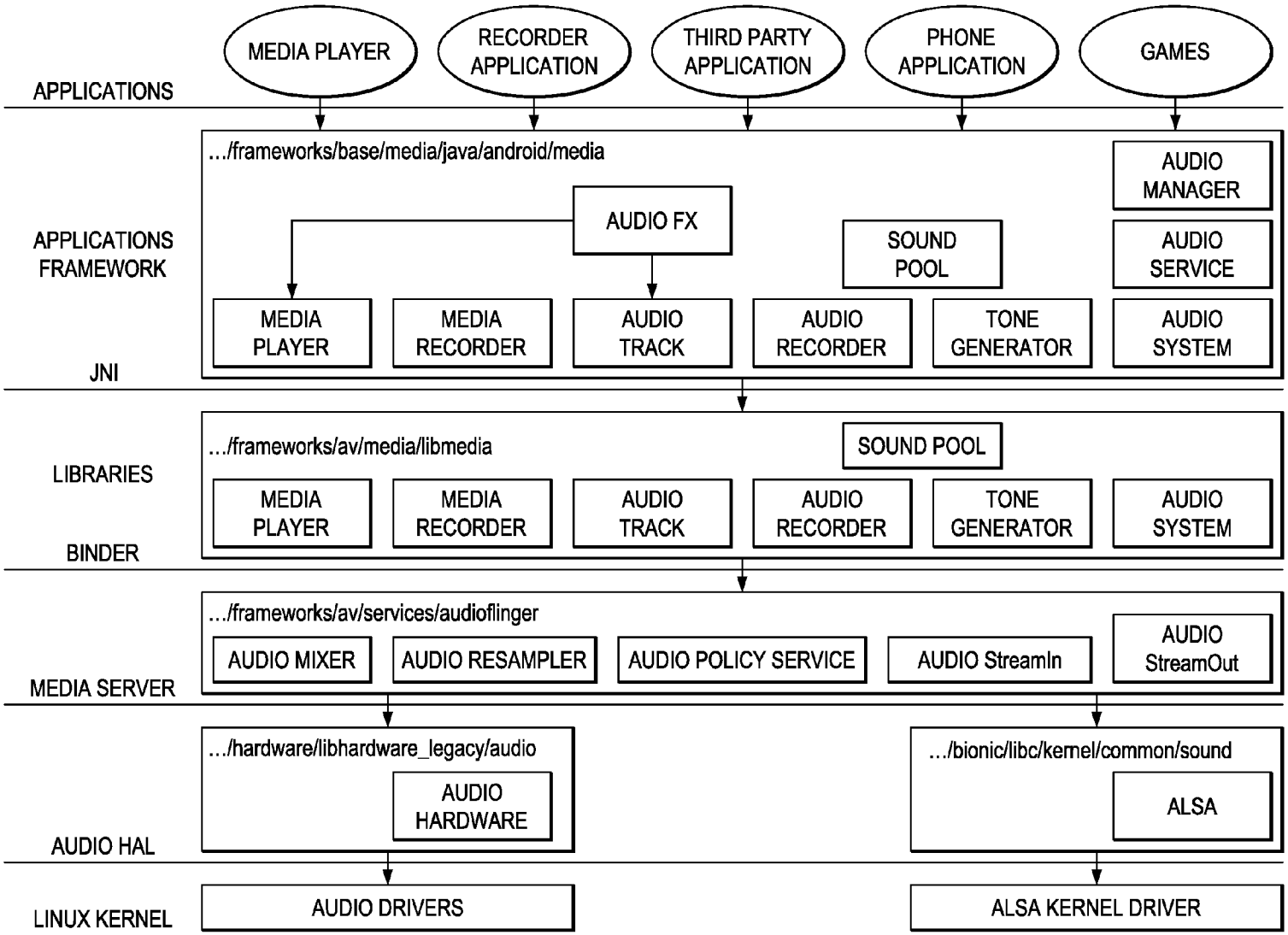
FIG. 7 illustrates a diagram of an embodiment Android operating system (OS) Audio SW stack.
Figure 8:
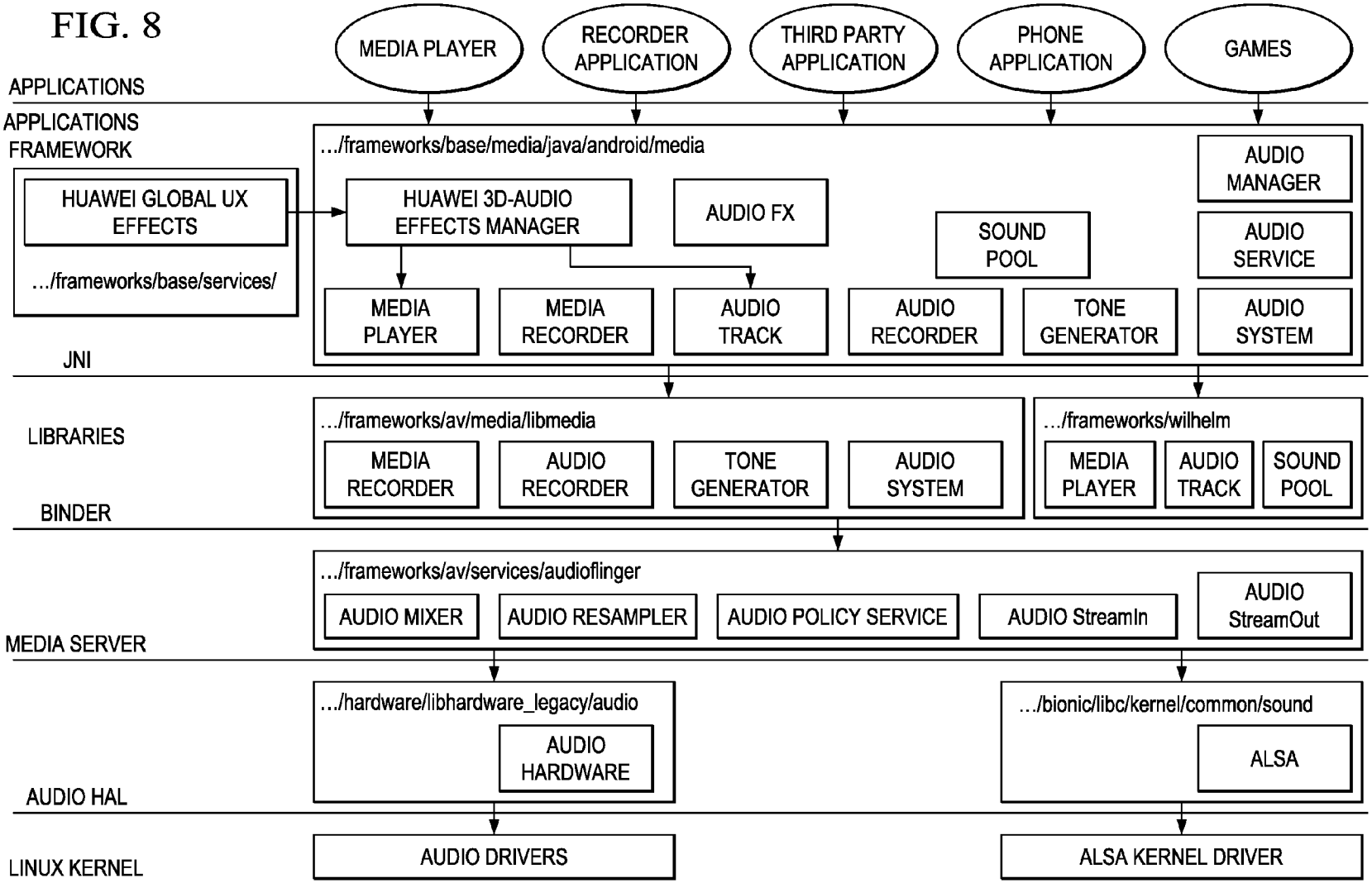
FIG. 8 illustrates a diagram of an embodiment 3D-Audio Effects engine.

FIG. 7 illustrates an example of an Android OS Audio SW stack, while FIG. 8 illustrates a diagram of a 3D-Audio Effects engine. One or more of the OpenSL ES SW stack, Android OS Audio SW stack, and 3D-Audio Effects engine may be used to implement embodiments of this disclosure. The Android OS Audio SW stack and the 3D-Audio Effects engine include applications for various applications, including applications for media players, recorders, phones, games, and third party applications. The applications are linked with LINUX audio driver and ALSA audio drivers through a sequence of application frameworks, java native interfaces (JNI), libraries, binders, media servers, and audio hardware abstraction layers (HALs).

Figure 9:
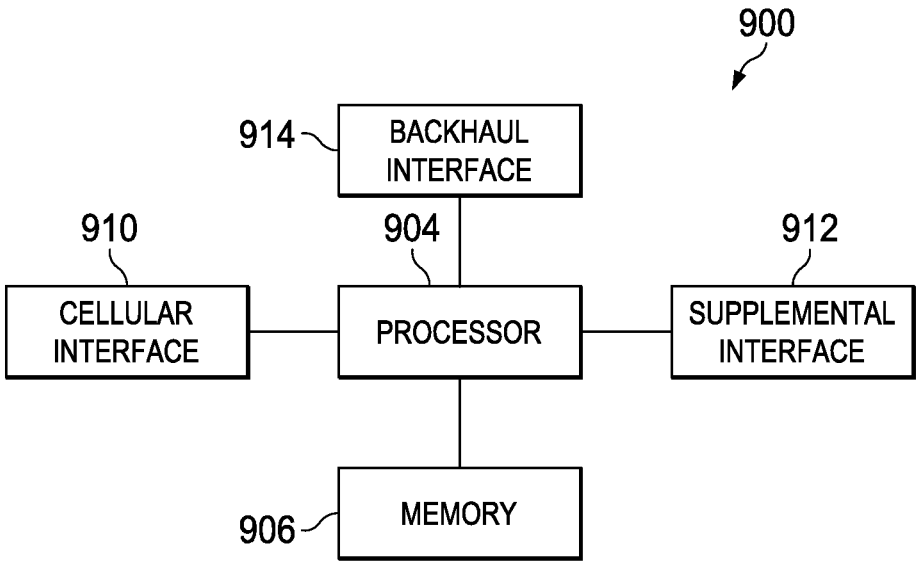
FIG. 9 illustrates a diagram of an embodiment communications device.

FIG. 9 illustrates a block diagram of an embodiment of a communications device 900, which may be equivalent to one or more devices (e.g., UEs, NBs, etc.) discussed above. The communications device 900 may include a processor 904, a memory 906, a cellular interface 910, a supplemental interface 912, and a backhaul interface 914, which may (or may not) be arranged as shown in FIG. 9. The processor 904 may be any component capable of performing computations and/or other processing related tasks, and the memory 906 may be any component capable of storing programming and/or instructions for the processor 904. The cellular interface 910 may be any component or collection of components that allows the communications device 900 to communicate using a cellular signal, and may be used to receive and/or transmit information over a cellular connection of a cellular network. The supplemental interface 912 may be any component or collection of components that allows the communications device 900 to communicate data or control information via a supplemental protocol. For instance, the supplemental interface 912 may be a non-cellular wireless interface for communicating in accordance with a Wireless-Fidelity (Wi-Fi) or Bluetooth protocol. Alternatively, the supplemental interface 912 may be a wireline interface. The backhaul interface 914 may be optionally included in the communications device 900, and may comprise any component or collection of components that allows the communications device 900 to communicate with another device via a backhaul network.

Figure 10:
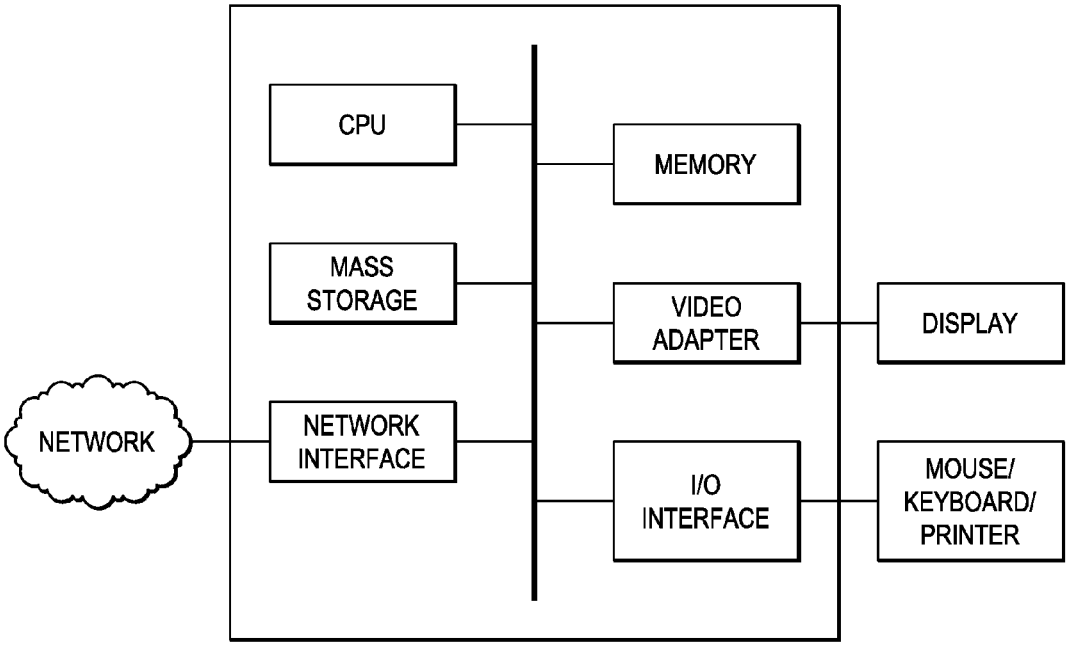
FIG. 10 illustrates an embodiment of a block diagram of a processing system.

FIG. 10 is a block diagram of a processing system that may be used for implementing the devices and methods disclosed herein. Specific devices may utilize all of the components shown, or only a subset of the components, and levels of integration may vary from device to device. Furthermore, a device may contain multiple instances of a component, such as multiple processing units, processors, memories, transmitters, receivers, etc. The processing system may comprise a processing unit equipped with one or more input/output devices, such as a speaker, microphone, mouse, touchscreen, keypad, keyboard, printer, display, and the like. The processing unit may include a central processing unit (CPU), memory, a mass storage device, a video adapter, and an I/O interface connected to a bus.

The bus may be one or more of any type of several bus architectures including a memory bus or memory controller, a peripheral bus, video bus, or the like. The CPU may comprise any type of electronic data processor. The memory may comprise any type of system memory such as static random access memory (SRAM), dynamic random access memory (DRAM), synchronous DRAM (SDRAM), read-only memory (ROM), a combination thereof, or the like. In an embodiment, the memory may include ROM for use at boot-up, and DRAM for program and data storage for use while executing programs.

The mass storage device may comprise any type of storage device configured to store data, programs, and other information and to make the data, programs, and other information accessible via the bus. The mass storage device may comprise, for example, one or more of a solid state drive, hard disk drive, a magnetic disk drive, an optical disk drive, or the like.

The video adapter and the I/O interface provide interfaces to couple external input and output devices to the processing unit. As illustrated, examples of input and output devices include the display coupled to the video adapter and the mouse/keyboard/printer coupled to the I/O interface. Other devices may be coupled to the processing unit, and additional or fewer interface cards may be utilized. For example, a serial interface card (not shown) may be used to provide a serial interface for a printer.

The processing unit also includes one or more network interfaces, which may comprise wired links, such as an Ethernet cable or the like, and/or wireless links to access nodes or different networks. The network interface allows the processing unit to communicate with remote units via the networks. For example, the network interface may provide wireless communication via one or more transmitters/transmit antennas and one or more receivers/receive antennas. In an embodiment, the processing unit is coupled to a local-area network or a wide-area network for data processing and communications with remote devices, such as other processing units, the Internet, remote storage facilities, or the like.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method for differentiating audio signals, wherein a first audio stream is obtained corresponding to a first audio signal and a second audio stream is obtained corresponding to a second audio signal, comprising:

modifying a first signal component in the first audio stream by a first amount in accordance with characteristics of the first audio signal to obtain a rendered audio stream if the characteristics of the first audio signal satisfy a criteria, or modifying the first signal component in the first audio stream by a second amount in accordance with characteristics of the first audio signal to obtain the rendered audio stream if the characteristics of the first audio signal fail to satisfy the criteria, wherein the second amount is different from the first amount; and emitting the rendered audio stream and the second audio stream simultaneously over one or more speakers.

2. The method of claim 1, wherein the characteristics of the first audio signal satisfy the criteria when an energy ratio of the audio signal in the time domain exceeds a threshold.

3. The method of claim 1, wherein the modifying further comprises:

amplifying the first signal component in the first audio stream by the first amount if the characteristics of the first audio signal satisfy the criteria, or amplifying the first signal component in the first audio stream by the second amount if the characteristics of the first audio signal fail to satisfy the criteria.

4. The method of claim 3, wherein amplifying the first signal component in the first audio stream comprises increasing or decreasing an amplitude of the first signal component in the first audio stream.

5. The method of claim 1, wherein the modifying further comprises:

phase-shifting the first signal component in the first audio stream by the first amount if the characteristics of the first audio signal satisfy the criteria, or phase-shifting the first signal component in the first audio stream by the second amount if the characteristics of the first audio signal fail to satisfy the criteria.

6. The method of claim 1, wherein the modifying further comprises:

shifting a frequency of the first signal component in the first audio stream by the first amount if the characteristics of the first audio signal satisfy the criteria, or shifting the frequency of the first signal component in the first audio stream by the second amount if the characteristics of the first audio signal fail to satisfy the criteria.

7. The method of claim 1, with obtaining the rendered audio stream further comprising: wherein performing audio rendering on the first audio stream comprises:

modifying the first signal component of the first audio stream by the first amount to obtain a first rendered signal component;

modifying a second signal component of the first audio stream by the second amount to obtain a second rendered signal component, wherein the first signal component and the second signal component have different frequencies; and combining the first rendered signal component with at least the second rendered signal component to obtain the rendered audio stream.

8. The method of claim 1, wherein the first audio signal carries multimedia content, and wherein the second audio signal carries voice content.

9. The method of claim 1, wherein the first audio signal and the second audio signal are perceived in different locations of a 3D audio (3D-Audio) virtual space by virtue of performing audio rendering on the first audio stream.

10. A method for manipulating audio streams, comprising:

emitting a first audio stream over one or more speakers during a first period, wherein the first audio stream corresponds to a first audio signal that is perceived in a front source of a three dimensional audio (3D-Audio) virtual space during the first period;

detecting a second audio stream corresponding to an incoming call;

shifting a signal component in the first audio stream from a first phase to a second phase over a second period to obtain a rendered audio stream;

simultaneously emitting the rendered audio stream and the second audio stream over the one or more speakers during the second period, wherein audio of the incoming call is perceived in the front source of the 3D-Audio virtual space during the second period, and wherein the first audio signal migrates from the front source to a rear source of the 3D-Audio virtual space in obtaining the rendered audio stream during the second period.

11. The method of claim 10, wherein the first audio signal carries multimedia content, and wherein the audio of the incoming call carries voice content.

12. The method of claim 10, wherein the first phase is associated with the front source of the 3D-Audio virtual space and the second phase is associated with the rear source of the 3D-Audio virtual space.

13. A method for manipulating audio streams, comprising:

emitting a first audio stream over one or more speakers during a first period, wherein the first audio stream corresponds to a first audio signal that is perceived in a front source of a three dimensional audio (3D-Audio) virtual space during the first period;

detecting a second audio stream corresponding to an incoming call;

shifting a signal component in the first audio stream from a first frequency to a second frequency over a second period to obtain a rendered audio stream;

simultaneously emitting the rendered audio stream and the second audio stream over the one or more speakers during the second period, wherein audio of the incoming call is perceived in the front source of the 3D-Audio virtual space during the second period, and wherein the first audio signal migrates from the front source to a rear source of the 3D-Audio virtual space in obtaining the rendered audio stream during the second period.

14. The method of claim 13, wherein the first audio signal carries multimedia content, and wherein the audio of the incoming call carries voice content.

15. The method of claim 13, wherein the first frequency is associated with the front source of the 3D-Audio virtual space and the second frequency is associated with the rear source of the 3D-Audio virtual space.

16. A mobile communications device, the device comprising:

a memory storage comprising non-transitory instructions; and a processor coupled to the memory that executes the instructions to:

modify a first signal component in the first audio stream by a first amount in accordance with characteristics of the first audio signal to obtain a rendered audio stream if the characteristics of the first audio signal satisfy a criteria, or modify the first signal component in the first audio stream by a second amount in accordance with characteristics of the first audio signal to obtain a rendered audio stream if the characteristics of the first audio signal fail to satisfy the criteria, wherein the second amount is different from the first amount, wherein a first audio stream is obtained corresponding to a first audio signal and a second audio stream is obtained corresponding to a second audio signal; and emit the rendered audio stream and the second audio stream simultaneously over one or more speakers.

17. The device of claim 16, wherein the characteristics of the first audio signal satisfy the criteria when an energy ratio of the audio signal in the time domain exceeds a threshold.

18. The device of claim 16, wherein the instructions to modify further comprise instructions to:

amplify the first signal component in the first audio stream by the first amount if the characteristics of the first audio signal satisfy the criteria, or amplify the first signal component in the first audio stream by the second amount if the characteristics of the first audio signal fail to satisfy the criteria.

19. The device of claim 18, wherein the instructions to amplify the first signal component in the first audio stream further comprise instructions to increase an amplitude of the first signal component in the first audio stream.

20. The device of claim 16, wherein the processor further executes the instructions to:

phase-shift the first signal component in the first audio stream by the first amount if the characteristics of the first audio signal satisfy the criteria, or phase-shift the first signal component in the first audio stream by the second amount if the characteristics of the first audio signal fail to satisfy the criteria.

21. The device of claim 16, wherein the processor further executes the instructions to:

shift a frequency of the first signal component in the first audio stream by the first amount if the characteristics of the first audio signal satisfy the criteria, or shift the frequency of the first signal component in the first audio stream by the second amount if the characteristics of the first audio signal fail to satisfy the criteria.

22. The device of claim 16, wherein the processor further executes the instructions to:

modify the first signal component of the first audio stream by the first amount to obtain a first rendered signal component;

modify a second signal component of the first audio stream by the second amount to obtain a second rendered signal component, the second amount being different from the first amount, wherein the first signal component and the second signal component have different frequencies; and combine the first rendered signal component with at least the second rendered signal component to obtain the rendered audio stream.

23. The device of claim 16, wherein the first audio signal carries multimedia content, and wherein the second audio signal carries voice content.

24. The device of claim 16, wherein the first audio signal and the second audio signal are perceived in different locations of a 3D audio (3D-Audio) virtual space by virtue of performing audio rendering on the first audio stream.

25. An apparatus for manipulating audio streams, comprising:

a memory storage comprising non-transitory instructions; and a processor coupled to the memory that executes the instructions to:

emit a first audio stream over one or more speakers during a first period, wherein the first audio stream corresponds to a first audio signal that is perceived in a front source of a three dimensional audio (3D-Audio) virtual space during the first period;

detect a second audio stream corresponding to an incoming call;

progressively shift a signal component in the first audio stream from a first phase to a second phase over a second period to obtain a rendered audio stream;

simultaneously emit the rendered audio stream and the second audio stream over the one or more speakers during the second period, wherein audio of the incoming call is perceived in the front source of the 3D-Audio virtual space during the second period, and wherein the first audio signal migrates from the front source to a rear source of the 3D-Audio virtual space in obtaining the rendered audio stream during the second period.

26. The apparatus of claim 25, wherein the first phase is associated with the front source of the 3D-Audio virtual space and the second phase is associated with the rear source of the 3D-Audio virtual space.

27. An apparatus for manipulating audio streams, comprising:

a memory storage comprising non-transitory instructions; and a processor coupled to the memory that executes the instructions to:

emit a first audio stream over one or more speakers during a first period, wherein the first audio stream corresponds to a first audio signal that is perceived in a front source of a three dimensional audio (3D-Audio) virtual space during the first period;

detect a second audio stream corresponding to an incoming call;

shift a signal component of the first audio stream from a first frequency to a second frequency over a second period to obtain a rendered audio stream;

simultaneously emit the rendered audio stream and the second audio stream over the one or more speakers during the second period, wherein audio of the incoming call is perceived in the front source of the 3D-Audio virtual space during the second period, and wherein the first audio signal migrates from the front source to a rear source of the 3D-Audio virtual space in obtaining the rendered audio stream during the second period.

28. The apparatus of claim 27, wherein the first frequency is associated with the front source of the 3D-Audio virtual space and the second frequency is associated with the rear source of the 3D-Audio virtual space.

* * * * *